US008525088B1

(12) United States Patent
Ell et al.

(10) Patent No.: US 8,525,088 B1
(45) Date of Patent: Sep. 3, 2013

(54) VIEW-POINT GUIDED WEAPON SYSTEM AND TARGET DESIGNATION METHOD

(75) Inventors: Todd A. Ell, Savage, MN (US); Robert D. Rutkiewicz, Edina, MN (US)

(73) Assignee: Rosemont Aerospace, Inc., Burnsville, MN (US)

( * ) Notice: Subject to any disclaimer, the term of this patent is extended or adjusted under 35 U.S.C. 154(b) by 0 days.

(21) Appl. No.: 13/426,114

(22) Filed: Mar. 21, 2012

(51) Int. Cl.
*F41G 7/34* (2006.01)
*F41G 7/00* (2006.01)

(52) U.S. Cl.
USPC ..... 244/3.17; 244/3.1; 244/3.15; 244/3.16; 382/100; 382/103; 701/400; 701/408; 701/514

(58) Field of Classification Search
USPC ..... 701/400, 408, 514; 345/418, 619, 345/649; 89/1.11; 244/3.1–3.19; 382/100, 382/103, 104, 154; 342/52–58, 61–66, 175, 342/195
See application file for complete search history.

(56) References Cited

U.S. PATENT DOCUMENTS 3,321,761 A 5/1967 Biagi et al.
3,652,837 A 3/1972 Perkins
4,119,968 A * 10/1978 Goldfischer ..... 342/64
4,164,728 A * 8/1979 Marsh ..... 342/64
4,175,285 A * 11/1979 Dansac et al. ..... 342/64
4,179,693 A * 12/1979 Evans et al. ..... 342/64
4,347,511 A * 8/1982 Hofmann et al. ..... 342/64
4,347,996 A 9/1982 Grosso
4,396,903 A * 8/1983 Habicht et al. ..... 382/103
4,490,719 A * 12/1984 Botwin et al. ..... 342/64
4,495,580 A * 1/1985 Keearns ..... 342/64
4,602,336 A * 7/1986 Brown ..... 342/64
4,690,351 A 9/1987 Beckerleg et al.
4,715,005 A * 12/1987 Heartz ..... 342/64
4,910,674 A * 3/1990 Lerche ..... 342/64
4,914,734 A * 4/1990 Love et al. ..... 342/64
5,052,045 A 9/1991 Peregrim et al.
5,136,297 A * 8/1992 Lux et al. ..... 342/64
5,146,228 A * 9/1992 Irani et al. ..... 342/64
5,201,895 A 4/1993 Grosso
5,260,709 A * 11/1993 Nowakowski ..... 342/62
5,272,639 A * 12/1993 McGuffin ..... 342/64
5,335,181 A * 8/1994 McGuffin ..... 342/64
5,341,142 A * 8/1994 Reis et al. ..... 342/64
5,359,526 A * 10/1994 Whittington et al. ..... 342/64
5,430,445 A * 7/1995 Peregrim et al. ..... 342/64
5,485,384 A * 1/1996 Falconnet ..... 342/64
5,564,650 A * 10/1996 Tucker et al. ..... 244/3.17
5,881,696 A 3/1999 Wada
5,890,808 A 4/1999 Neff et al.
6,016,116 A * 1/2000 Henderson et al. ..... 342/64
6,111,241 A 8/2000 English et al.
6,157,875 A 12/2000 Hedman et al.

(Continued)

*Primary Examiner* — Bernarr Gregory
(74) *Attorney, Agent, or Firm* — Edwards Wildman Palmer LLP; Scott D. Wofsy; George N. Chaclas

(57) ABSTRACT

A passive guidance system including a viewpoint capture system (VCS) including a first processor in communication with first memory and a first SWIR imager for creating a viewpoint image database having a plurality of images, at least one of the images having a target point. A weapon guidance module is in communication with the VCS and coupled to a weapon. The weapon guidance module includes a second processor in communication with second memory and a second SWIR imager for storing the viewpoint image database and correlating in-flight images from the second SWIR imager to provide guidance commands directing the weapon to the target point.

20 Claims, 8 Drawing Sheets

(56) References Cited

U.S. PATENT DOCUMENTS

| | | | | |
|---|---|---|---|---|
| 6,347,264 | B2 * | 2/2002 | Nicosia et al. | 342/64 |
| 6,529,614 | B1 | 3/2003 | Chao et al. | |
| 6,633,317 | B2 * | 10/2003 | Li et al. | 345/649 |
| 6,757,422 | B1 * | 6/2004 | Suzuki et al. | 382/154 |
| 6,873,998 | B1 * | 3/2005 | Dorum et al. | 342/64 |
| 6,885,939 | B2 * | 4/2005 | Schmidt et al. | 382/104 |
| 6,982,666 | B2 * | 1/2006 | Temes et al. | 342/64 |
| 6,987,256 | B2 | 1/2006 | English et al. | |
| 7,089,560 | B1 | 8/2006 | Uhler et al. | |
| 7,191,056 | B2 | 3/2007 | Costello et al. | |
| 7,522,090 | B2 * | 4/2009 | Hawkinson | 342/64 |
| 7,725,257 | B2 | 5/2010 | Strelow et al. | |
| 7,831,086 | B2 * | 11/2010 | Kondo et al. | 382/154 |
| 7,858,939 | B2 | 12/2010 | Tener et al. | |
| 7,909,253 | B2 | 3/2011 | Sherman | |
| 8,005,612 | B2 * | 8/2011 | Asahara et al. | 342/64 |
| 8,138,960 | B2 * | 3/2012 | Nonaka et al. | 342/64 |
| 2009/0248304 | A1 | 10/2009 | Roumeliotis et al. | |
| 2011/0017864 | A1 | 1/2011 | Roemerman | |

* cited by examiner

VIEW-POINT GUIDED WEAPON SYSTEM AND TARGET DESIGNATION METHOD

BACKGROUND OF THE INVENTION

1. Field of the Invention

The subject disclosure relates to guided weapon systems, and more particularly to an improved guidance system employing an imager and a method for designating a target which provides precision strike capability but that does not need the active-designate-until-impact requirement.

2. Background of the Related Art

Typical weapon guidance systems utilize target designation systems to achieve high accuracy hit-placement. In existing technology, a semi active laser (SAL) target designator (LTD) is used to illuminate an intended target or a chosen spot on a target. The weapon system homes in on illumination reflected from the target to strike the target. These laser guided weapons require the laser designator operator (LDO) to designate the target until weapon impact. Hence, the laser designator operator must remain in the target vicinity. By being in the target vicinity, the LDO such as a forward observer or designator aircraft and the associated crew, are in danger. Such targeting systems are considered active. Examples of targeting systems are disclosed in U.S. Pat. No. 3,321,761 issued on May 23, 1967 to Biagi et al. and U.S. Pat. No. 3,652,837 issued on Mar. 28, 1972 to Perkins, U.S. Patent App. Pub. No. 2011/0017864 A1 published on Jan. 27, 2011 to Roemerman, U.S. Pat. No. 4,347,996 issued Sep. 7, 1982 to Grosso, and U.S. Pat. No. 7,059,560 B2 issued Jun. 13, 2006 to Ljungberg et al.

Active laser guided weapons which are designate-until-impact impose limitations on operations. First, a line of sight (LOS) must exist between the designator and target and between the target and laser acquisition system on the weapon. Second, the direction of attack must allow the laser acquisition system to sense sufficient energy reflected from the designated target, minimize false target indications, and preclude the weapon from guiding onto the designator. Finally, the laser designator must designate the target at the specific correct time and for the proper duration.

Various guided weapons also have viewing systems to capture and evaluate images containing the target and its surrounding region as seen from the weapon. This allows the weapon to track targets passively. However, passive image guided weapons require a means to detect and acquire a target autonomously. Autonomous target acquisition requires preloaded images or models of the desired target and a means of correlating or matching the preloaded images with the live current image as seen from the weapon during flight. These methods are limited in operation due to the large number of possible closure geometries and environmental conditions required in the preloaded target images. For examples, see U.S. Pat. No. 5,201,895 issued Apr. 13, 1993 to Grosso, U.S. Pat. No. 4,690,351 issued Sep. 1, 1987 to Beckerleg et al., U.S. Pat. No. 5,052,045 issued Sep. 24, 1991 to Peregrim et al., U.S. Pat. No. 5,881,969 issued on Mar. 16, 1991 to Miller, U.S. Pat. No. 5,890,808 issued on Apr. 6, 1999 to Neff et al., and U.S. Pat. No. 6,157,875 issued on Dec. 5, 2000 to Hedman et al., as well as U.S. Pat. No. 6,529,614 B1 issued on Mar. 4, 2003 to Chao et al.

Such systems require an on-board high-resolution, variable magnification lens system, which greatly increases the cost and complexity of the weapon. Further, such systems do not have a direct assessment at launch time of the weapon's ability to acquire or maintain lock using the preloaded images. Lacking this assessment to compute a probability of success metric leads to weapon launches that fail to acquire a lock and thus never strike the intended target. Such a failure requires a post mission analysis to determine why the weapon failed and reduces the confidence in the system. Missing a real time predictive success metric also prevents the weapons launch officer from modifying the parameters of the mission which would otherwise improve the odds of success.

Various guided weapons also combine active laser designation and passive imaging so that the benefits of both can be used. Typically active designation is used to acquire the target and passive imaging is used to track the acquired target to impact. Examples of these mixed-mode systems are U.S. Pat. No. 6,987,256 B2 issued on Jan. 17, 2006 to English et al., U.S. Pat. No. 6,111,241 issued on Aug. 29, 2000 to English et al., and U.S. Pat. No. 7,858,939 B2 issued on Dec. 28, 2010 to Tener et al. However, these kinds of combined systems are also very costly and complex, particularly considering that the entire weapon is intended to be expendable. In order for successful operation, there is the need to ensure the proper hand-off between the laser designation of the target and the passive acquisition of said target. One such method of aligning these two subsystems is given in U.S. Pat. No. 7,909,253 issued on Mar. 22, 2011 to Sherman.

In order to reduce image guided weapon total cost, some weapons attempt to eliminate portions of the navigation system required to deliver the weapon into the vacinity of the target. By providing a pre-loaded database of geo-referenced images, an on-board imager attempts to correlate the current view from the weapon with the database images to estimate current location, velocity, acceleration and other navigation information. For examples of such image-aided navigation systems, see U.S. Pat. No. 7,725,257 issued on May 25, 2010 to Strelow et al., U.S. Pat. No. 7,191,056 issued on Mar. 13, 2007 to Costello et al., and U.S. Patent App, Pub. No. 2009/0248304 A1 published on Oct. 1, 2009 to Roumeliotis et al. However, these systems require that the images in the database be accurately geo-referenced, which is a costly process.

SUMMARY

The subject technology includes a viewpoint capture system that allows a forward observer (FO) to use a laser target designator (LTD) to designate a desired target. Once designation occurs, the viewpoint capture system records and provides an imager-based weapon guidance system a video sequence of an expected or similar view to that as seen from the weapon in flight from the launch system to target impact. The guidance module on the weapon is passive in flight and, thus, minimizes the active designation dwell time on the target while being as accurate as designate-to-impact seeker guidance systems. In effect, the laser target designator can designate-and-forget a target, allowing the forward observer to leave the area earlier such as before launch of the weapon.

It is an object of the subject technology to alleviate the need for weapons to have an on-board high-resolution, variable magnification lens system. In one embodiment, image data and target point data is transmitted by means of radio links. Alternatively, image data and target point data is transmitted by high bandwidth data signal embedded on laser target designator output. Potential Target points may be automatically identified from target identification database maintained in the view point capture system.

It is further an object of the technology to provide a means to allow a direct assessment, at launch time, of the weapon's ability to acquire or maintain lock on the designated target to impact. In another embodiment, a method allows multiple forward observers to designate multiple targets and separate each target into separate viewpointimage databases (with the same image capture sequence, but different target pixels and target point). Another method has the weapon determine a relative location in terms of range to target, bore-site angles, and slant angles guide the missile to the target point.

It is further an object of the technology to alleviate the need to provide the weapon guidance system an extensive target signature database which covers a multitude of weapon-to-target closure geometries and target illumination conditions. It is further an object of the technology to alleviate the need to provide the weapon guidance system a geo-referenced image, or geo-referenced map, database.

Various embodiments may have different engagement modes. Both laser active and imager-passive guidance systems can be used. A passive imager-guided mode would be fire-and-forget. The weapon can be re-targeted by identifying an active laser target designator in its in-flight field of view and switching to standard laser guided mode. If passive-only flight to target is not possible, then guidance may be available. Multiple target "lock on" methods include lock-on after launch capable, which is a method that provides lock-on after launch capability by starting viewpoint image database search after launch. The method can be aided by a navigation system when known distance to geo-located target is supplied. The system can also be lock-on before launch capable, which is a method that provides positive lock-on indication before launch which can be both line-of-sight and non line-of-sight to the target point. On-the-fly target re-designation is possible, which is a method that allows the weapon to be re-targeted by having the weapon look for specific laser target designation codes pre-programmed into the weapon before launch and that switches from passive-imager to active-laser guidance. Robust weapon maneuvering to target is also possible to incorporate, which is a method that allows the weapon trajectory to be shaped to avoid obstacles by shaping the VCS captured viewpoint image database. Robust to confusion and counter measures, the technology allows the target point to be temporarily obscured because the field-of-view is used to shape guidance commands, not the target point only within each viewpoint image. The technology can provide a wide field-of-regard without the use of imager gimbals since the partial overlap in field-of-view between the viewpoint image and current in-flight images is sufficient to resolve target location even when target pixel is not in the current field-of-view. The subject technology also provides optimal distribution of expendable weapon costs by using lower cost fixed focal length, strapped-down imagers in the weapon. A high performance viewpoint capture systems with telephoto zoom and 2-axis gimbals for panning imager is reused for multiple weapon launches.

In one embodiment, the subject technology is directed to a viewpoint capture system (VCS) including a first processor in communication with a first memory unit and a first Shortwave Infrared (SWIR) imager for creating a viewpoint image database having a plurality of images, each having a targeted pixel, and at least one of the images having a designated target point. A viewpoint guidance module (VGM) is coupled to the weapon and is in communication with the VCS. The VGM includes a second processor in communication with a second SWIR imager and a second memory for storing the viewpoint image database, and correlating in-flight images from the second SWIR imager to provide guidance commands directing the weapon to the designated target point.

A further embodiment of the subject technology includes a laser target designator, typically used by a forward observer, to designate the target point in the viewpoint VCS images. Preferably, the first SWIR imager has automatic telescopic optical zooming capability and is gimbaled to allow automatic laser spot tracking. The VCS operator may instead manually select the target point as seen from the first SWIR imager.

A further embodiment of the subject technology includes a VCS laser target designator coupled to the first SWIR imager to designate the target allowing the forward observer to use a third SWIR imager to passively identify when the correct target is laser designated.

Another embodiment of the subject technology is a method for guiding a missile weapon including the steps of creating a viewpoint image database by using an imaging system to capture a plurality of views of a target point at a plurality of focal lengths, downloading the viewpoint image database to a weapon guidance module on a weapon, launching the weapon, and correlating in-flight weapon images from an on-board imaging system with images in the viewpoint image database to determine guidance commands for the missile to hit the target point. Another embodiment is to have a fourth SWIR imager in a UAV fly a trajectory while recording images and georeference positions or locations to create the viewpoint image database. This is used in case a complex trajectory is needed to navigate in a non line-of-sight to target. Still another embodiment is to use multiple SWIR imagers located at various distance and angles with views of the same target or laser designation. These may be forward observers or UAV's. The images are transmitted to the VCS from the various locations and are then either stitched together or used to synthetically generate a projectile trajectory image database by the VCS.

Preferably, a minimal magnification setting image in the viewpoint image database approximately matches an initial in-flight missile image. The method may also automatically tag an individual pixel within each image as the target pixel. The weapon determines a relative location in terms of range to target, bore-site angles, and slant angles to guide the weapon-to the target point. The method may also determine if passive-only flight to target is possible before launching the weapon.

It should be appreciated that the present technology can be implemented and utilized in numerous ways, including without limitation as a process, an apparatus, a system, a device, a method for applications now known and later developed or a computer readable medium. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the following drawings.

DETAILED DESCRIPTION OF PREFERRED EMBODIMENTS

Figure 1:
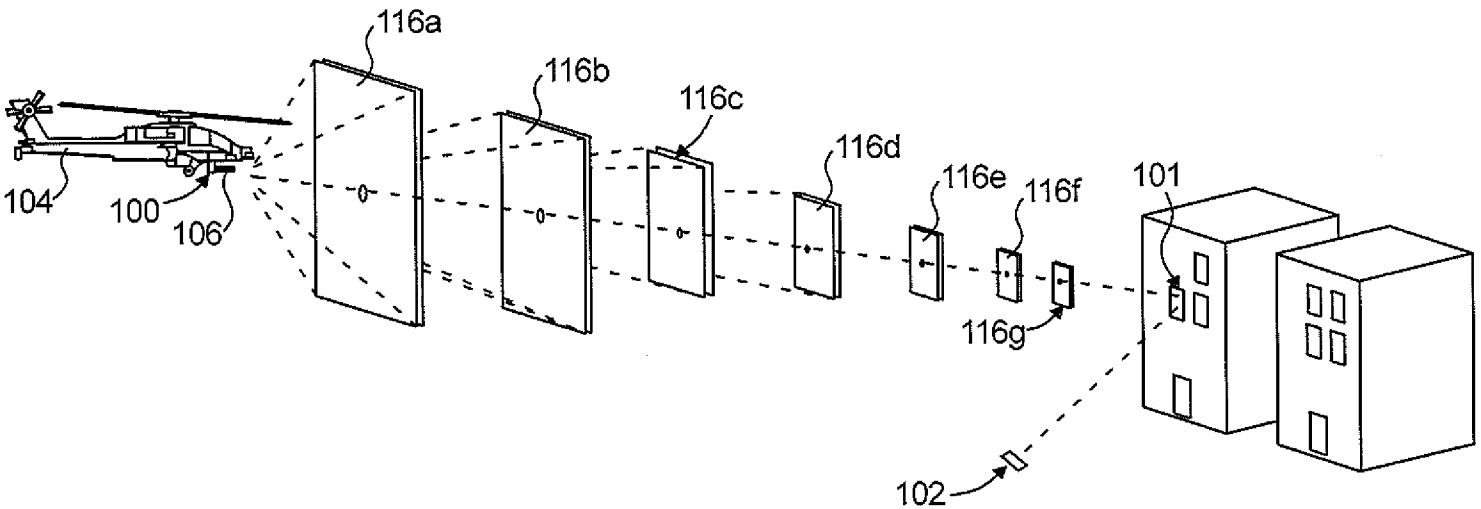
FIG. 1 is graphical representation of a viewpoint image creation sequence of a designated target using a viewpoint capture system (VCS) and forward observer using a laser target designator (LTD) in accordance with the subject technology.

The present invention overcomes many of the problems associated with the prior art of weapon guidance systems. The advantages, and other features of the weapon guidance systems disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

Referring now to FIG. 1, a viewpoint image creation sequence of a designated target using a viewpoint capture system (VCS) 100 and laser target designator (LTD) 102 in accordance with the subject technology is shown. The LTD 102 is optional as discussed hereinbelow. The VCS 100 is on-board a rotary wing aircraft 104 (shown) or fixed wing aircraft as the case may be. The aircraft 104 also carries a payload of one or more weapons 106 such as a missile with a SWIR strap-down staring focal-plane imager-seeker guidance system (not shown explicitly but represented schematically in FIG. 2A).

Figure 2:
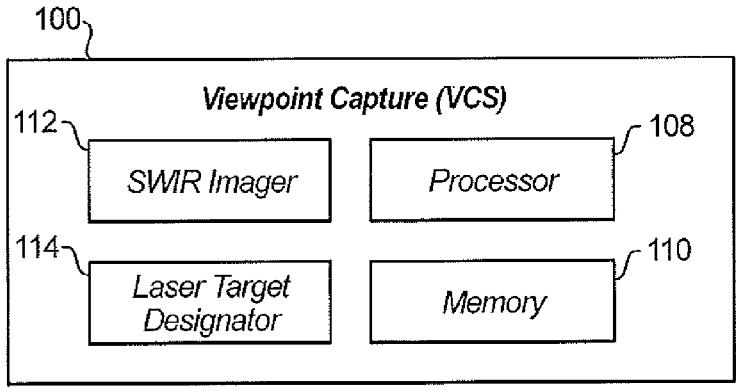
FIG. 2 is a schematic representation of a VCS in accordance with the subject technology.

Referring now to FIG. 2, a functional module level schematic of VCS 100 in accordance with the subject technology is shown. The VCS has a targeting interface for an operator. This targeting interface is used to point the camera gimbal in the method of VCS operator scanning and selecting the target and in the method to point the VCS laser desiginator. The VCS 100 includes a processor 108 in communication with memory 110. The memory 110 stores an instruction set and any necessary data so that when the processor 108 is running the instruction set, the VCS 100 can accomplish the tasks necessary to accomplish the functional goals of the subject technology. The VCS 100 also includes a gimbaled SWIR imager 112 with a mechanical optical zoom mechanism. A VCS laser target designator 114 is aligned and fixed to the SWIR imager 112.

Figure 2A:
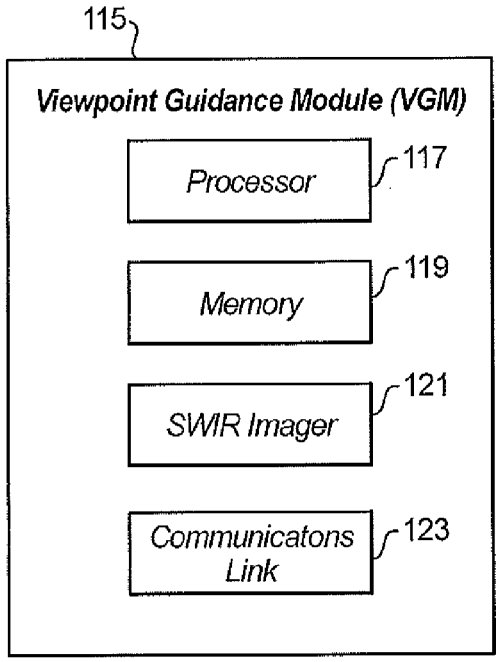
FIG. 2A is a schematic representation of an on-board viewpoint guidance module (VGM) for a weapon in accordance with the subject technology.

Referring now to FIG. 2A, an on-board SWIR imager-seeker viewpoint guidance module (VGM) 115 for the weapon 106 in accordance with the subject technology is shown schematically. The guidance module 115 also has a processor 117 in communication with memory 119. The memory 119 stores an instruction set and any necessary data so that when the processor 117 is running the instruction set, the on-board guidance module 115 can accomplish the tasks necessary to accomplish the functional goals of the subject technology. The weapon 106 also includes a SWIR imager 121 and communications equipment or link 123 for sending and receiving data with the VCS 100 as needed.

The SWIR imager 121 of the SWIR imager-seeker guidance module 115 on the weapon 106 and the SWIR imager 112 of the VCS 100 can detect the laser designation spot in the respective field-of-view. The weapon 106 contains enough processing power to correlate current images with stored images in real-time or near real-time.

Referring again to FIG. 1, a forward observer uses the LTD 102 to select and identify the target point 101. The VCS 100 directs the gimbaled SWIR imager 112 so that the target point 101 is within a field of view of the SWIR imager 112. Alternatively, the laser target designator 114 of the VCS 100 may designate the target point 101. In this case, the forward observer 102 may verify the correct target point 101 using a separate SWIR camera which does not need to be aligned or fixed to the LTD 102. As a result, the forward observer 102 can be covert and entirely passive. A second alternative is for the VCS 100 operator to manually via the targeting interface use only the SWIR imager 121 to visually identify the target point 101 making the entire target designation process passive.

In Operation

A method for using the view-point seeker weapon guidance system of the subject technology includes a pre-launch sequence of operations. In one method, a VCS 100 operator scans and zooms the SWIR imager 112 into a potential target area to select the target point 101. Once the target point 101 is identified by the operator, the operator locks the indicated target point 101 in a known manner.

The forward observer's LTD 102 can also designate the target point 101 for locking by directing a laser point thereon. The SWIR imager 112 has a gimbal mechanism to scan and automatically zoom to the laser point in order to lock the associated target point 101. The forward observer receives lock indication for the VCS 100, which allows the forward observer to disengage the target point and leave the area. In low and poor lighting conditions, the VCS 100 may activate the LTD 114 to provide the target point 101 or SWIR illumination, which would also allow the forward observer to leave the area.

Various automatic and manual methods now known and later developed may be used to communicate between the forward observer and the VCS 100. For example, a radio frequency (RF) link, a laser link, forward observer audio link and the like may be used. The RF link is a simple message stating that the VCS 100 has a designated target point 101 to successfully track. The laser link can also use a LTD 114 in the VCS gimbal to confirm the target by lasing the same point.

Once locked on the target point 101, the processor 108 of the VCS 100 determines the range to the target point 101. In one method, the microprocessor 108 uses the LTD 114 and the SWIR imager 112 as a LADAR system to determine the distance to the target point 101.

Still referring to FIG. 1, a process for the VCS 100 capturing a sequence of SWIR image pairs 116 over a range of different zoom settings is illustrated. In one embodiment, the captured SWIR image pairs 116*a-g* are equally spaced from a maximum optical zoom setting (represented by image pair 116*g*) to a minimum optical zoom setting (represented by image pair 116*a*). Although seven pairs 116*a-g* are shown, any number of pairs may be captured. Each pair 116*a-g* includes an actively designated shot and a non-actively designated shot. All of the images in the pairs 116*a-g* preferably include the target point 101 within the field of view.

The memory 110 of the VCS 100 also includes acceleration and glide velocity characteristics of the weapon 106 to generate an optimized set of image pairs 116 that allow for efficient guidance data. Efficient guidance data also includes image transformations when the VCS SWIR imager 112 and the seeker imager of the weapon 106 are not aligned along the entire flight path. The guidance module 115 uses an image translation offset converted to target bearing angles. Solving the slant range/angles between two images taken at two locations of the same object is called the relative pose estimation problem. The CLS 100 and guidance module 115 convert the slant range/angle information into trajectory guidance commands via affine image transform methods.

The guidance module 115 can also use the scale difference for range estimation when the size of the target is known by using the viewpoint images 116 to maintain the range estimation across the weapon trajectory. The CLS 100 can use the viewpoint images 116 to perform range estimation when the size of the target is known or the initial range to the target be known.

For each pair 116*a-g*, the processor 108 of the VCS 100 extracts the pixel location of the designated target point 101 in the active shot and stores the corresponding pixel coordinates with the corresponding passive shot image in the memory 110. The active images are no longer used and can be discarded. The memory 110 has stored a viewpoint image database consisting of the passive or clean images that the weapon 106 should see with the pixel coordinates of the target point 101 in each image. Each such image with the pixel coordinates is hereinafter referred to as a viewpoint image. The viewpoint images are sorted by magnification order from minimal zoom (image 116*a*) to maximum zoom (image 116*g*), which corresponds to range-to-target. Preferably, the viewpoint image database is created very close to launch time in order to minimize image correlation failure due to changes in lighting conditions and like. However, even if prepared well in advance, the stable items such as buildings and road edges provide excellent image correlation.

The VCS 100 uses the total range and magnification setting of each viewpoint image 116 to calculate the equivalent range-to-target as if the SWIR imager 112 were at that range without magnification. The result is a sequence of range-to-target passive images that corresponds to the intended view as would be seen by the weapon-SWIR imager while in flight to the target point 101.

Figure 3:
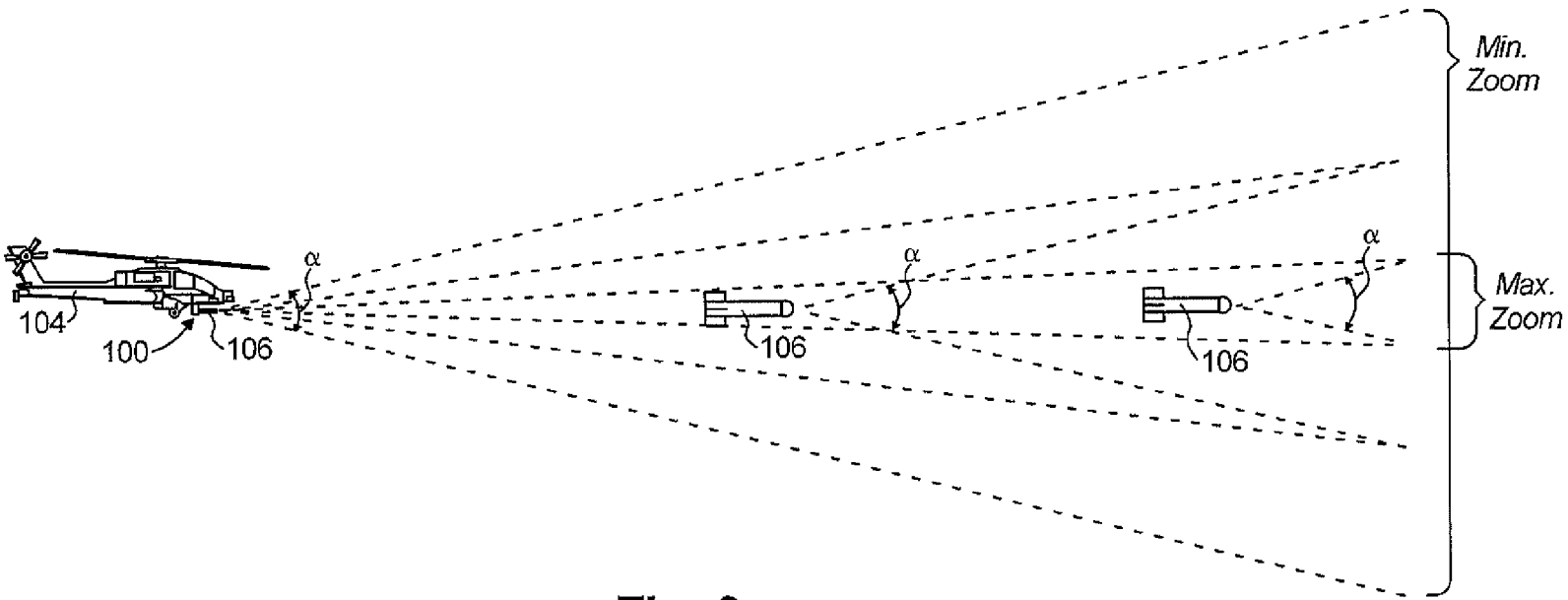
FIG. 3 is a graphical representation of aligned viewpoint images with weapon in-flight view at equivalent ranges to target in accordance with the subject technology.

Referring now to FIG. 3, a graphical representation of aligned viewpoint images 116 with weapon in-flight view at equivalent ranges to target in accordance with the subject technology is shown. The viewing angles cc are depicted as equal for the VCS SWIR imager 112 at minimal zoom and the fixed field of view imager 121 of the weapon 106, however such a match is not necessary. In a preferred embodiment, the number of pixels on target from both SWIR imagers would match when SWIR imager 112 is at minimal zoom. In order to prepare the weapon 106 for flight, the VCS 100 transfers the viewpoint image database to the weapon 106 via the communications links 123.

Figure 4:
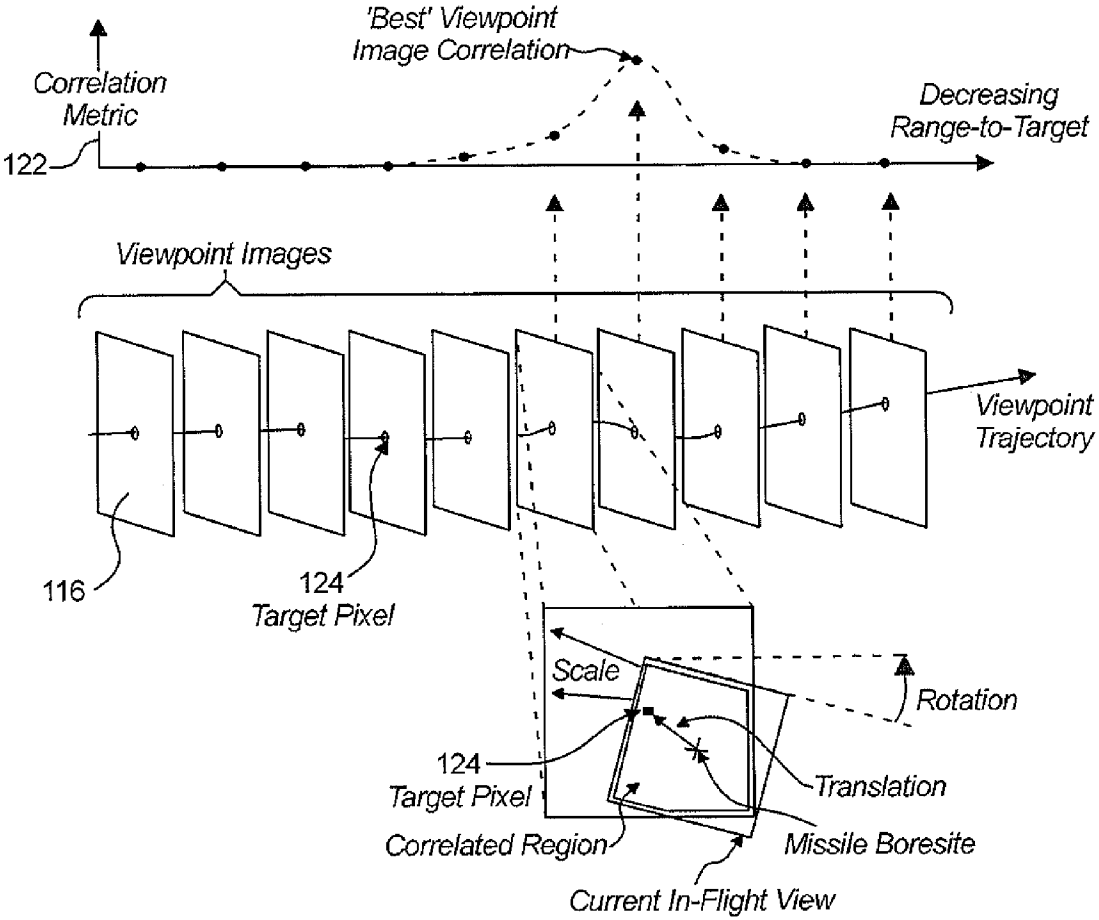
FIG. 4 is a graphical representation of a flight-view correlation process in accordance with the subject technology.

Referring now to FIG. 4, a graphical representation of a flight-view correlation process in accordance with the subject technology is shown. While the weapon 106 is still on the aircraft 104, the weapon 106 is still in a fixed relationship to the VCS 100. To prepare for launch, the weapon 106 can correlate the top or minimal zoom viewpoint images 116. Typically, this would be possible for a helicopter holding a position during preparation for a launch as shown in FIG. 3.

Correlation is the weapon 106 finding a match between a stored viewpoint image 116 and a source image 120 captured by the weapon 106. More generally, the weapon 106 searches through the viewpoint images 116 to find a match based upon a metric that represents the quality of the correlation match. Once a matching image is found, the weapon 106 can determine the scale, translation and rotation that aligns the stored viewpoint image 116 to a portion of the captured weapon source image. The scale, translation and rotation is transformed into guidance commands for the weapon 106. The correlation process can be streamlined to run in real-time.

FIG. 4 also includes a graph 122 illustrating how the weapon 106 can select a matching viewpoint image 116 for correlation. The graph 122 is a correlation metric against viewpoint images 116 in a decreasing range to target. As the weapon 106 captures an image along the trajectory of the viewpoint image sequence, several viewpoint images 116 can correlate, each viewpoint image 116 having a different scale, translation and rotation solution. By using the viewpoint image 116 with the best correlation metric value, the correlation process should be more accurate and less computationally burdensome.

During flight, if the weapon 106 veers off the intended trajectory but still points in the direction of the targeted pixel 124, further more advanced correlation such as using affine transforms can be used to correct and maintain accurate guidance. An affine match on top of the standard scale-translation-rotation adjustment additionally yields the change in aspect angle between the viewpoint trajectory and the in-flight view. Each of these corrections are translated into guidance commands to accomplish motion to align the weapon trajectory to the viewpoint trajectory. It is envisioned that, in the early stages of flight, the weapon 106 may travel around obstacles (e.g., deviate from the viewpont trajectory) and return to the viewpoint trajectory towards the target point 101.

Advanced correlation can include such additional parameters as changes in viewing aspect angles to determine correct motion (i.e., guidance commands) for aligning and re-aligning the weapon trajectory to the viewpoint trajectory. The weapon 106 uses the scale for correlation to determine weapon range-to-target, the translation to determine the bearing angles to target, and rotation to determine current flight-view weapon body roll attitude.

When the weapon 106 is still loaded on the aircraft 104 and a viewpoint image 116 and current weapon image is correlated, the weapon 106 provides a signal to the VCS 100 that the weapon is ready to launch. When the time to launch comes, the VCS 100 commands the weapon 106 to launch. The weapon 106 will attempt to maintain the best correlated viewpoint image's target pixel 124 in its current in-flight view. As the weapon approaches the target 101, the weapon 106 aligns the weapon's bore-site with the target pixel 124. The target pixel 124 need not even be within the weapon's current in-flight view, all that needs to exist is a partial correlated overlap between the two images for the weapon to know where the target point 101 is relative to its view.

In the event that the VCS 100 notifies the operator that viewpoint-based guidance is not possible, control of the weapon 106 reverts to classical active laser guidance operation. The forward observer is notified that laser designate-to-impact control is required. Typically, if the VCS 100 cannot correlate selected images within the viewpoint image database against other images, either forward or backward in range, within the database, then success without designate-to-impact control would not be likely.

The VCS 100 can also utilize a small area of pixels surrounding the target pixel 124 as well as salient points in the images 116. By analyzing a small portion of pixels surrounding the target pixel 124 or even in intermediate images 116, the VCS 100 can predictively determine whether or not the missile 106 will be able to maintain lock on the target pixel 124. For example, the area surround the target pixel 124 may include salient points that allow correlation and, thus, tracking to the target point 101. Salient points refer to portions of the viewpoint image 116 that are unique enough to electronically track against scale, translation, and/or rotation changes without loosing lock or confusing landmarks. For example, the corner of a building can be identified across a large scale of magnifications is an excellent salient tracking point whereas a large stretch of sand dunes looks very much alike and becomes ambiguous if you lose track of the specific dune being tracked.

Since each viewpoint image 116 can be correlated with respect to other images in the same database before weapon launch, the VCS 100 can be determined before missile launch if there is sufficient rich enough in salient points to successfully correlate with the subsequent in-flight views. After launch, the VCS 100 is typically no longer used and can work on other tasks such as subsequent missile firings.

Several other parameters can be evaluated as well including illumination. Poor illumination can make distinguishing salient points difficult and also be identified before weapon launch as actually or potentially preventing correlation. In view of the above, pre-launch analysis of viewpoint database can be performed. As noted above, if the analysis is unfavorable, designation until impact can be done. If the missile 106 includes a radio down-link, the missile 106 can inform the CLS 100 and user of a loss-of-lock while in flight, then if the designator operator is quick enough, the SAL designator 114 can be activated on the target point 101 to guide the missile 106 into impact using designation until impact operations.

As best seen in FIG. 4, post-launch, the weapon 106 performs in-flight operations. The weapon's SWIR imager's current view is correlated against the viewpoint images 116, in sequence, to find a correlation. If no correlation is found and every viewpoint image 116 has been searched, the weapon 106 is deemed to have lost lock on the target point 101. When the weapon 106 does find a correlation match among the viewpoint images 116, the weapon 106 continues to search forward in range through the viewpoint images to determine the correlation metric maximum, which indicates the best viewpoint image correlation. The best viewpoint image correlation is the best estimate of where the missile 106 is on the viewpoint trajectory as mapped by the CLS 100. In one embodiment, the best estimate occurs when the overlapping correlated region matches and the scale matches indicating the viewpoint image's stored range to target as mapped by the VCS 100 matches the weapon's current range to target. The weapon 106 uses the scale, translation and rotation parameters related to the best viewpoint image 116 to compute the range to target, bearing angles to target, and the weapon rotation to align the weapon 106 to the viewpoint trajectory, as best graphically represented in FIG. 3.

As the weapon 106 continues to move toward the target point 101, the forward search through the viewpoint images 116 to find a correlation match to a current source image from the weapon imager 121 repeatedly occurs. As a result, the weapon trajectory is continually adjusted to maneuver the weapon 106 onto the target point 101 in decreasing range through the viewpoint image database. It is noted that the weapon SWIR imager 121 does not need to resolve the target at maximum range. Thus, the fixed field-of-view of the SWIR imager 121 can be set to optimize the weapon's ability to hold lock on the target point 101 rather than resolve the target in the current field-of-view. In one embodiment, the VCS 100 does not need to resolve the target at the minimum or intermediate zooms. Only at maximum zoom is minimal target detail needed to ensure accurate target hit placement.

In another embodiment, the forward observer also includes a SWIR camera so that the personnel associated with or the forward observer can determine when to disengage the target point 101 based upon a matching co-designation from the VCS 100. The hand-off from the forward observer to the VCS 100 occurs quickly, within seconds, thus the forward observer can disengage his LTD 102 even before the viewpoint database creation is finished. Advantageously, the personnel associated with the FODS 102 have additional time to exit the target area with the designate-and-forget technology of the subject disclosure.

The forward observer can also designate multiple targets, preferably sequentially, having a single weapon locked to each designated target point 101 by one or more VCS 100. Hence, multiple weapons 106 can be subsequently launched to impact all the targets simultaneously or in a staggered manner. The forward observer is optional in that the VCS 100 may provide an image display to a VCS operator for manual target selection. The VCS-100 may also include a gimbaled LTD 114 for when insufficient image detail is available due to low ambient lighting and a LTD 102 unavailable to the forward observer. When image correlation is based on more than a single designation point, such as salient features in the field-of-view, the resulting guidance system is more robust to changing variables such as moving vehicles and battle smoke within the in-flight weapon's field of view.

Figure 7:
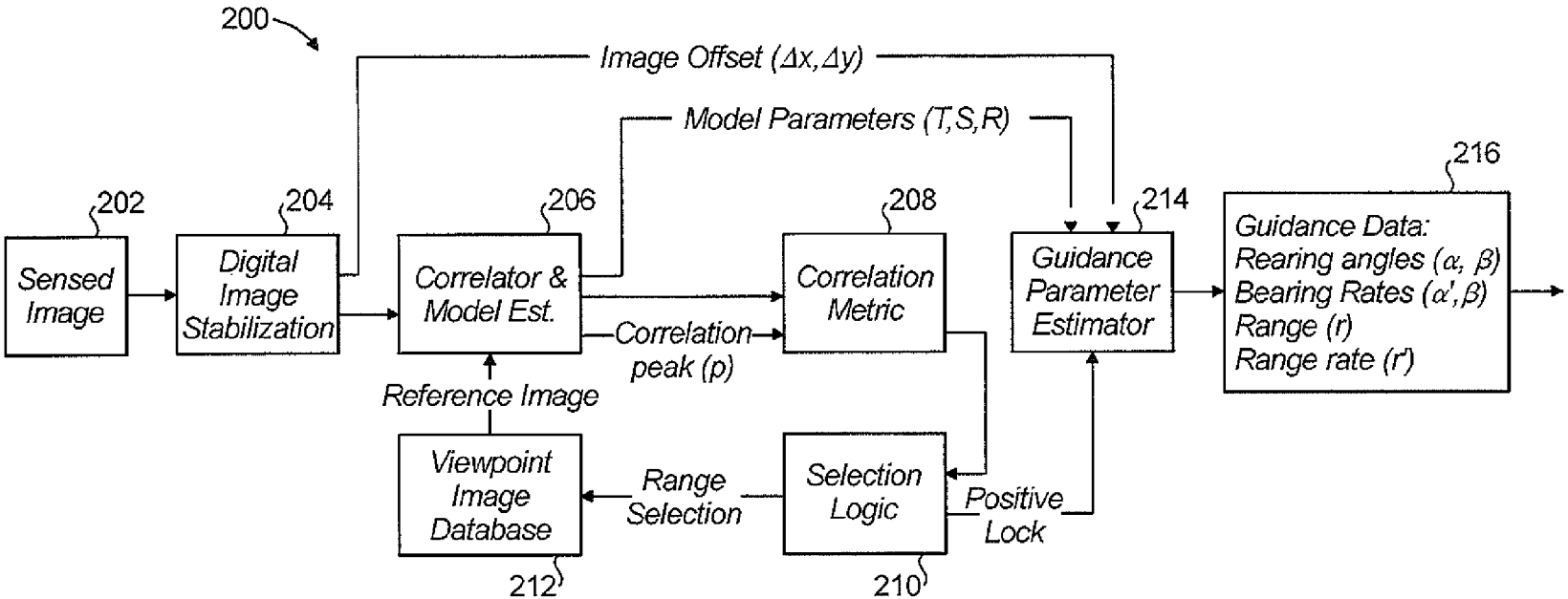
FIG. 7 is a graphical representation of the image processing data flow onboard the viewpoint-guided weapon in accordance with the subject technology.

Referring to FIG. 7, a graphical representation of the image processing data flow 200 in the guidance module 115 onboard the viewpoint-guided weapon 106 is shown. Initially at step 202, the guidance module 115 uses the SWIR imager 121 to capture the images. At step 204, digital image stabilization shifts the sensed image from frame to frame of sensed video. This shifting is enough to counteract SWIR imager motion due to weapon vibration and coning and, thus provide better trajectory track estimation. The digital image stabilization outputs a stabilized sensed image and also reports the pixel offset ($\Delta x$, $\Delta y$) required to align the video images.

At step 206, the guidance module 115 uses correlation and model estimation methods or template matching to determine the overlap between the current in-flight view and the selected viewpoint image 116. The preferred technique is matched to the structure of the transform model. In one embodiment, the transform model is a similarity transform. Hence, the model consists of translation T, rotation R, and scaling S. Normalized cross-correlation exploits for matching direct image intensities, without any structural analysis also occurs. The correlation peak p is a direct measure of the quality of match.

At step 208, correlation metric combines the correlation peak p with the scale S, which provides an estimate of range to the target 101. The estimate of the range to the target 101 provides a metric as to how well the current sensed image matches the reference image selected from the viewpoint image database. If the correlation metric were computed for every image in the viewpoint image database, the correlation as depicted in FIG. 4 would result.

At step 210, the guidance module 115 uses selection logic to determine the best viewpoint image 116 to correlate with the current sensed, in-flight view. One technique is to perform a linear search from the last best registration image to perform range estimation using the viewpoint image database as shown in step 212. The range selection is used to maintain positive lock on the target point 101 and the process iterates through steps 206, 208, 210 and 212.

In another embodiment at step 210, the guidance module 115 estimates the expected range to target and performs a gradient search from a point in the database. If no match is found and the entire database has been searched, the weapon 106 has lost lock on the target point 101. When a match has been found, the guidance module 115 continues to search forward in range, through the database, until the registration metric reaches a maximum. The maximum corresponds to or allows estimation of where the weapon 106 is on the viewpoint trajectory mapped out by the VCS 100.

Upon indication of a positive lock, the guidance module 116 provides parameters translation T, scale S and rotation R to determine guidance parameter estimation at step 214. The best translation T is used to compute bearing angles ($\alpha$, $\beta$) and bearing angle rates ($\alpha'$, $\beta'$). Since range to the target is known for the reference image and the scale S between the sensed, in-flight images is known, an estimate of the range (r) to the target can be determined, as well as, range rate (r'). At step 216, the guidance parameters are converted into guidance data to direct the path of the weapon 106. In one embodiment, the guidance data includes bearing angles ($\alpha$, $\beta$), bearing angle rates ($\alpha'$, $\beta'$), range (r) and range rate (r').

Additional Alternative Embodiments

Figure 5:
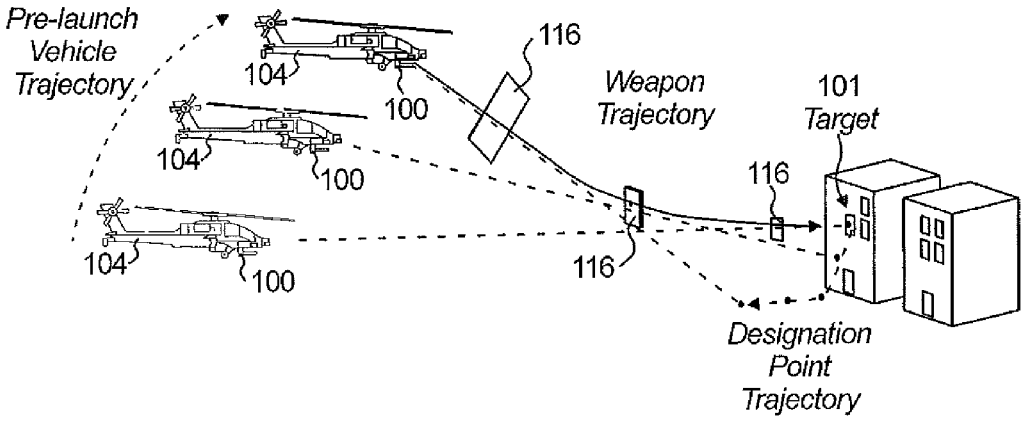
FIG. 5 is a graphical representation of another viewpoint image creation sequence of a designated target using a moving aircraft with a VCS and LTD in accordance with the subject technology.

Referring now to FIG. 5, a graphical representation of another viewpoint image creation sequence of a designated target using a moving aircraft 104 with a VCS 100 and LTD 102 in accordance with the subject technology. As can be seen, the VCS 100 is robust with respect to VCS 100 motion during capturing the viewpoint images 116 provided that the designator spot remains in the field-of-view of the VCS SWIR imager 112. Even though the bearing and distance for each captured image 116 may change, the correlation between the weapon images and captured viewpoint images 116 still accurately guides the weapon 106 to the target point 101.

The subject technology is also robust with respect to designation point movement during viewpoint image capture. The minimal magnification viewpoint images are particularly immune to minor designation point movement whereas it is more important to have the designation point tight on target during the high magnification setting capture of the viewpoint images. For the most part, the maneuverability of the weapon determines the margin for error in having the designation point moving during viewpoint image capture. As a result, the designator can be pulled off target slightly and/or temporarily, which reduces designator dwell time on the target and, thus, lowers the probability of detection by personnel and equipment associated with the target.

Further, the subject technology greatly reduces the sophistication required of the imager 121 of the weapon 106. For example, the imager 121 does not need variable magnification. Further, the imager 121 can be a fixed staring system (e.g., non-gimbaled) because correlation between in-flight view and the viewpoint images 116 can occur as long as portions of the two images overlap. In other words, the pixel representing the target point 101 does not even need to be in the in-flight view. Hence, the effective field-of-regard is wider than the actual field-of-view of the imager 121 without the complexity of a gimbaled seeker system.

Figure 6:
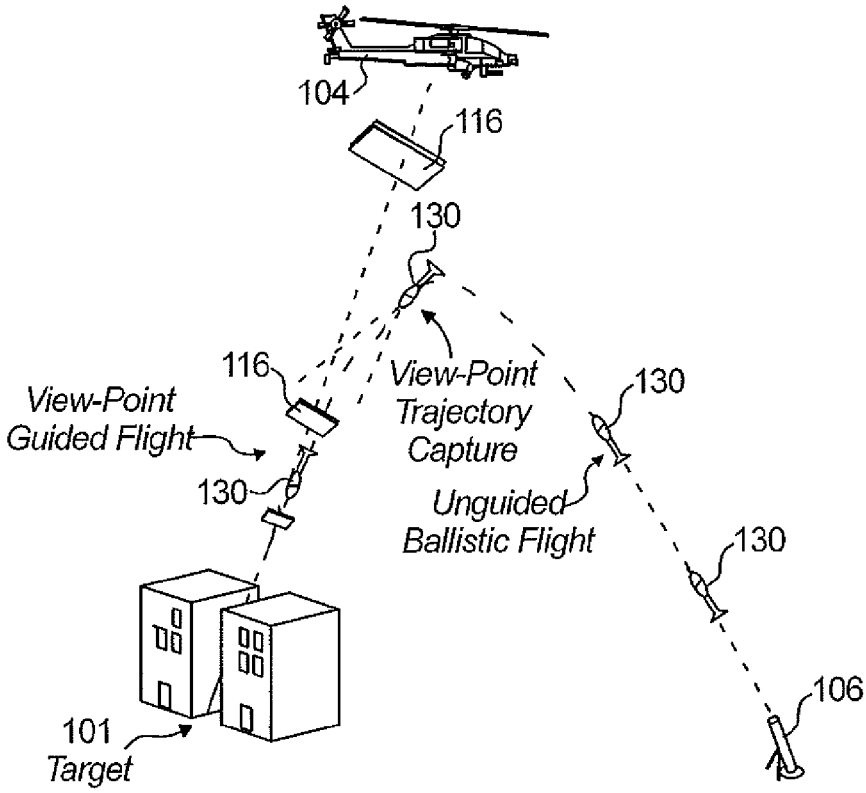
FIG. 6 is a graphical representation of another viewpoint image creation and later weapon flight sequence of a designated target for a non-missile mortar weapon in accordance with the subject technology.

Referring to FIG. 6, a graphical representation of another viewpoint image creation sequence of a designated target for a non-missile weapon 106 having a mortar 130 in accordance with the subject technology is shown. Initially, the mortar 130 is loaded with the viewpoint image database from the VCS 100 or other source, then launched. As can be seen, the initial portion of the mortar weapon flight is unguided but eventually the mortar weapon flight approximately merges with the viewpoint trajectory created by a viewpoint capture system on-board the aircraft 104. Once the mortar weapon flight and viewpoint trajectory are close, correlation occurs to provide accurate guidance to the weapon 106 for the remainder of the flight to the target point 101. Hence, non-line-of-sight launch points are capable from a ground location or even an aircraft.

An exemplary application of the subject technology is for an un-manned aerial vehicle (UAV), also known as a unmanned aircraft system (UAS), which is piloted remotely or autonomously. When a UAV is paired with a mortar, the UAV contains the VCS and the mortar includes a viewpoint guidance seeker imager. Generally, the subject technology allows for re-designation after launch. Thus, the missile or mortar can be instructed to re-target or abort the mission while in flight. Re-targeting can be done is several ways, such as uploading to the weapon an new viewpoint image database, or to switching to laser guided mode.

Figure 8:
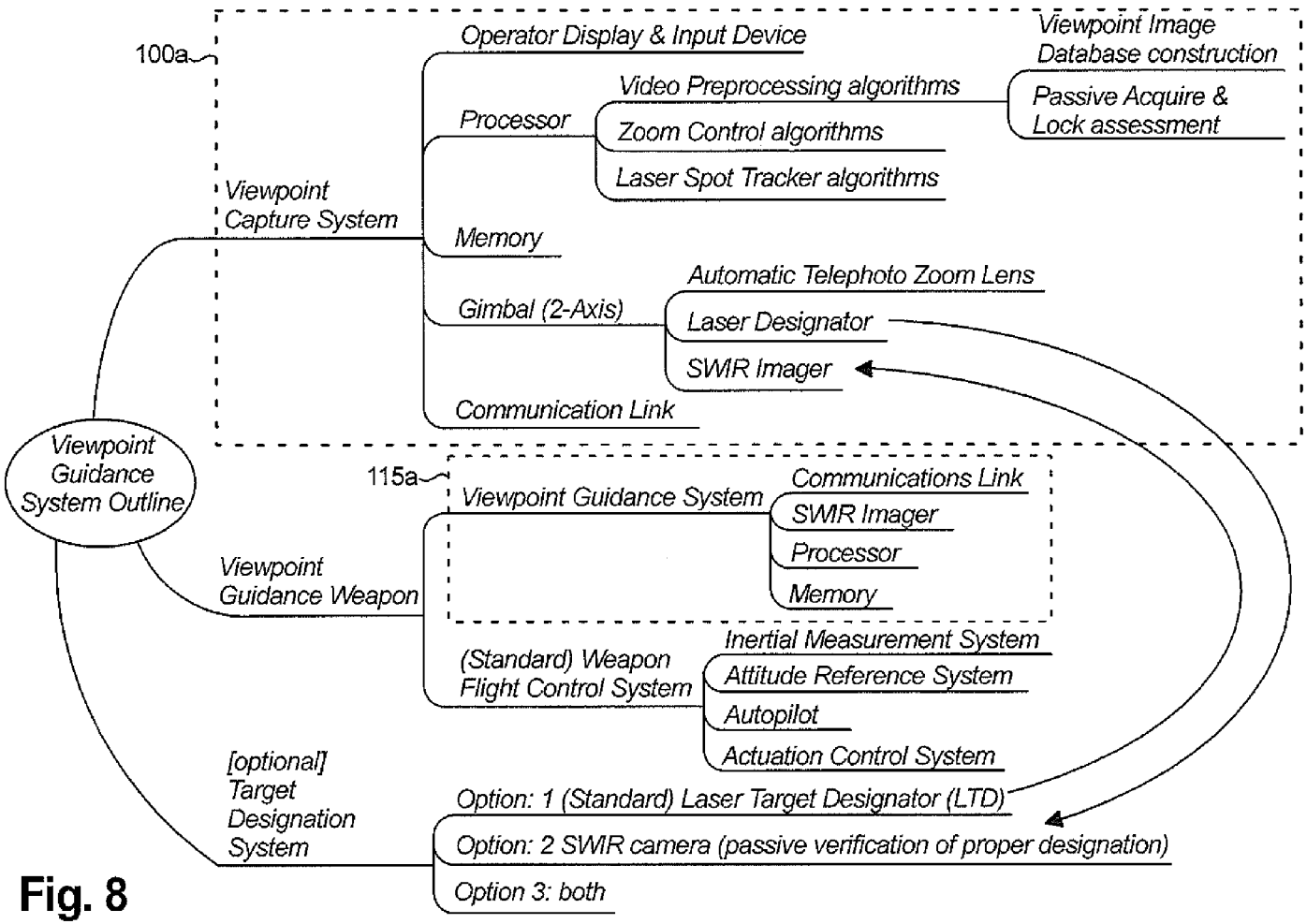
FIG. 8 is a graphical representation of the viewpoint guidance system in accordance with the subject technology.

Referring now to FIG. 8, a graphical representation of viewpoint guidance system 100*a* in accordance with the subject technology is shown. Similar components to the embodiments above are labeled with similar numbers and the designation "a" afterwards. FIG. 8 includes additional optional hardware and data flow as would be understood by those of ordinary skill in the art based upon review of the teachings herein.

INCORPORATION BY REFERENCE

All patents, published patent applications and other references disclosed herein are hereby expressly incorporated in their entireties by reference.

While the invention has been described with respect to preferred embodiments, those skilled in the art will readily appreciate that various changes and/or modifications can be made to the invention without departing from the spirit or scope of the invention.

We claim:

1. A weapon guidance system for allowing a forward observer to use a target designator in advance of weapon launch comprising:
   a) a viewpoint capture system (VCS) including a first processor in communication with first memory and a first shortwave infrared (SWIR) imager for creating a viewpoint image database having a plurality of images, at least one of the images having a target point being indicated by the target designator; and
   b) a guidance module for coupling to a weapon including:
      i) second memory for storing the viewpoint image database;
      ii) a second shortwave infrared (SWIR) imager for creating in-flight images for storage in the second memory; and
      iii) a second processor in communication with the second memory for correlating the images in the viewpoint image database with the in-flight images to generate guidance commands directing the weapon to the target point.

2. A weapon guidance system as recited in claim 1, wherein the target designator only designates the target point during capturing the plurality of images for the viewpoint image database and the first SWIR imager has automatic telescopic optical zooming capability.

3. A weapon guidance system as recited in claim 1, wherein the forward observer manually selects the target point.

4. A weapon guidance system as recited in claim 1, wherein the forward observer verifies the target point of the VCS using a third shortwave infrared (SWIR) imager.

5. A method for guiding a weapon comprising the steps of:

creating a viewpoint image database by using an imaging system to capture a plurality of views of a target point at a plurality of focal lengths;

downloading the viewpoint image database to a guidance module on the weapon;

launching the weapon; and correlating in-flight weapon images from an on-board imaging system with the plurality of views in the viewpoint image database to determine guidance commands for the weapon to hit the target point.

6. A method as recited in claim 5, wherein a minimal magnification setting image in the viewpoint image database approximately matches an initial in-flight weapon image.

7. A method as recited in claim 5, further comprising the step of automatically tagging an individual pixel within at least one view as the target point.

8. A method as recited in claim 5, wherein the weapon determines a relative location in terms of range to target, bore-site angles, and slant angles for guiding the weapon to the target point based on the correlating step.

9. A method as recited in claim 5, further comprising the step of designating the target point with a forward observation designation system.

10. A method as recited in claim 5, wherein the step of designating the target only occurs during the creating step.

11. A method as recited in claim 5, further comprising the step of determining if passive-only flight to target is possible before launching the weapon.

12. A target designation system comprising:

a viewpoint capture system (VCS) including a first processor in communication with first memory and a first shortwave infrared (SWIR) imager for creating a viewpoint image database having a plurality of images at a plurality of magnification levels, each image with a designated target pixel, wherein at least one of the images has a target point; and a weapon guidance module in communication with the VCS for coupling to a weapon, the weapon guidance module including a second processor in communication with second memory and a second shortwave infrared (SWIR) imager for storing the viewpoint image database and correlating in-flight images from the second SWIR imager to provide guidance commands directing the weapon to the target point.

13. A target designation system as recited in claim 12, wherein an active forward observer manually selects the target point with a laser target designator (LTD) at a high magnification level and the VCS selects target pixels at all other magnification levels.

14. A target designation system as recited in claim 13, wherein a laser target tracking system pans the first SWIR imager to hold the active forward observer's laser designated target in a respective field-of-view.

15. A target designation system as recited in claim 12, wherein a passive forward observer: verifies that a laser target designator (LTD) has designated a correct target point using a third shortwave infrared (SWIR) imager; and captures at least one image and selects the target point in the at least one image then sends the at least one image data with the target point to the VCS, then the VCS matches the at least one transmitted image with at least one of the images captured by the VCS.

16. A target designation system as recited in claim 12, wherein the target point is selected from identified potential targets based on a metric for priority, tracking success and operator input.

17. A method for designating a target comprising the steps of:

creating a viewpoint image database by using an imaging system to capture a plurality of views of a target point at a plurality of magnification settings;

downloading the viewpoint image database to a weapon guidance module on a weapon before weapon launch; and automatically tagging an individual pixel within each view as the target point.

18. A method as recited in claim 17, wherein a minimal magnification setting image in the viewpoint image database approximately matches an initial in-flight missile image and the target point is designated only during the creating step.

19. A method as recited in claim 17, further comprising the step of estimating probability of tracking success from launch to final target point in passive-only flight and using a metric based upon the tracking success probability to prioritize target points when multiple potential target points are available.

20. A method as recited in claim 17, further comprising the steps of:

locking on to the target point before launch to ensure the weapon has identified the target point before launch; and minimizing a laser target designator's dwell time on a vicinity of the target point by reducing a designation time on the vicinity to a short initial period during viewpoint image capture.

* * * * *